United States Patent [19]

Carmichael et al.

[11] 3,941,111

[45] Mar. 2, 1976

[54] IGNITION SYSTEM

[75] Inventors: Thomas F. Carmichael, Drayton Plains; Richard J. Maier, Pontiac, both of Mich.

[73] Assignee: Syncro Corporation, Oxford, Mich.

[22] Filed: Sept. 10, 1973

[21] Appl. No.: 395,908

[52] U.S. Cl. ..... 123/148 E; 123/149 C; 123/149 D; 310/70 A; 310/153; 315/209 SC; 315/218

[51] Int. Cl.[2] ..... F02P 3/08; F02P 3/06

[58] Field of Search .. 123/148 E, 148 MC, 148 OC, 123/148 IC, 149 E; 310/70 R, 70 A, 153; 315/218, 209 CD, 209 SC

[56] References Cited

UNITED STATES PATENTS

| | | | |
|---|---|---|---|
| 3,049,642 | 8/1962 | Quinn | 123/148 E X |
| 3,114,851 | 12/1963 | Santi | 310/153 |
| 3,367,314 | 2/1968 | Hirosawa et al. | 123/148 E |
| 3,405,347 | 10/1968 | Swift et al. | 123/148 E X |
| 3,461,851 | 8/1969 | Stephens | 123/149 |
| 3,484,677 | 12/1969 | Piteo | 322/91 |
| 3,498,281 | 3/1970 | Harkness | 315/209 R X |
| 3,500,809 | 3/1970 | Hohne et al. | 123/148 E |
| 3,504,373 | 3/1970 | Strelow | 315/218 |
| 3,515,109 | 6/1970 | Farr | 123/148 E |
| 3,542,007 | 11/1970 | Minks | 123/148 E |
| 3,553,529 | 1/1971 | Strelow | 123/148 E X |
| 3,598,098 | 8/1971 | Sohner | 123/148 E |
| 3,623,466 | 11/1971 | Palmer | 123/148 E |
| 3,646,605 | 2/1972 | Plume, Jr. | 123/148 E |
| 3,667,441 | 6/1972 | Cavil | 123/148 E |
| 3,703,889 | 11/1972 | Bodig et al. | 123/148 E |
| 3,704,700 | 12/1972 | Wesemeyer | 123/148 E |
| 3,828,754 | 8/1974 | Carlsson | 123/148 E X |
| R27,704 | 7/1973 | Carmichael et al. | 123/148 E |

*Primary Examiner*—Charles J. Myhre
*Assistant Examiner*—Tony Argenbright
*Attorney, Agent, or Firm*—Harness, Dickey & Pierce

[57] ABSTRACT

In one embodiment, a capacitive discharge ignition system has a charge coil and an ignition coil including primary and secondary windings wound on a common stator structure. The charge coil is coupled to the primary winding of the ignition coil by an SCR and a main capacitor such that the capacitor is first charged by the charge coil and then discharged through the SCR into the primary winding of the ignition coil when the SCR fires. During discharge of the capacitor, the charge coil also supplies current to the primary winding of the ignition coil. The SCR may be fired by a triggering circuit which includes a capacitor network connecting the gate of the SCR to the charge winding and main capacitor or through a breakdown effect of the SCR absent the provision of a triggering circuit. The circuit arrangement obviates the need for the usual charging diode between the charging coil and the main capacitor. Several embodiments of triggering circuit for the SCR are disclosed.

42 Claims, 3 Drawing Figures

IGNITION SYSTEM

BACKGROUND AND SUMMARY OF THE INVENTION

The present invention relates generally to ignition systems for internal combustion engines and in particular to improvements in ignition systems of the capacitor discharge type.

In order to reduce the complexity, the number of component parts, the package size, and the cost of capacitor discharge ignition circuits, various circuit arrangements have been tried in an attempt to improve such circuits without sacrificing desired operating performance and reliability. In accordance with such objectives, the prior art includes various circuit arrangements for charging the capacitor during a portion of the engine operating cycle and thereafter discharging the capacitor, through an SCR or the like, at a desired time in the engine cycle.

The present invention is directed to improvments in capacitor discharge ignition systems, and particularly, to a capacitor discharge ignition system having novel features which result in important advantages over prior art capacitor discharge ignition systems. One of these features is the utilization of a single winding for both charging the capacitor and for providing a trigger signal for the SCR whereby the cost and complexity of the system are reduced. Another of these is the provision of an ignition coil on the stator structure having the charge/trigger winding so that the primary winding of the ignition coil is energized, not only by the discharge of the capacitor, but also simultaneously by the magnetic field used to induce a charging current in the charge/trigger winding so as to increase the power supplied to the spark plug. Another feature is a provision in the circuit for resonant charging of the capacitor by which substantially maximum potential on the capacitor is attained at the time at which the capacitor is discharged so as to eliminate the necessity of the usual charging diode for the capacitor. And yet another feature is the connection of the charging coil in series with the discharge path for the capacitor so that the charge winding current augments the current from the discharging capacitor to further improve the potential supplied to the spark plug. Further novel features involve the construction and arrangement of the magnetic circuit structure via which the system is energized and various triggering circuits for the SCR through which the capacitor is discharged into the primary of the ignition coil. By virtue of the several embodiments of the invention disclosed herein, a capacitor discharge ignition system can provide excellent performance over a wide range of engine speeds without the complexity generally associated with prior capacitor discharge ignition systems. Thus, a system according to the present invention may be economically constructed and compactly packaged for use with many types of engines, for example, single cylinder gasoline engines such as are used in power lawn motors, etc. Further advantages and features of the invention will be seen in the ensuing description and claims which are to be taken in conjunction with the accompanying drawing.

BRIEF DESCRIPTION OF THE DRAWINGS

The drawings illustrate preferred embodiments of capacitor discharge ignition systems according to the present invention and in accordance with the best mode presently contemplated for carrying out the invention.

DESCRIPTION OF THE PREFERRED EMBODIMENT

Figure 1:
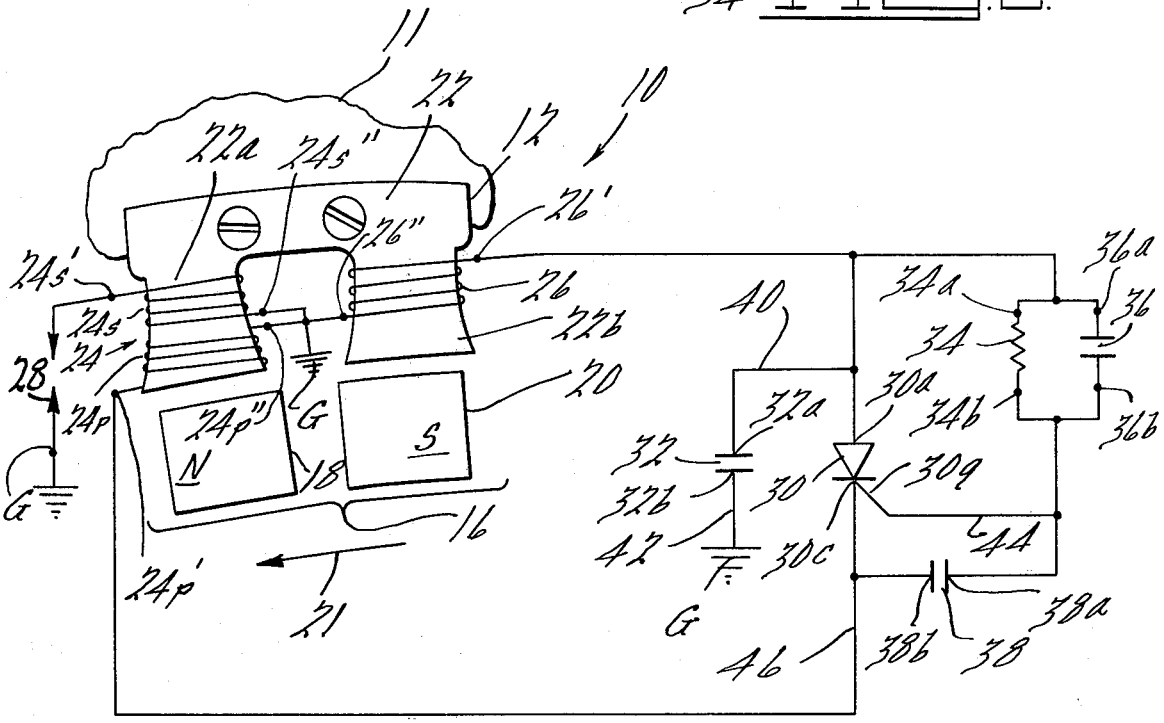
FIG. 1 is an electrical schematic diagram of a first embodiment of a capacitor discharge ignition system according to the present invention.

In FIG. 1, a capacitor discharge ignition circuit 10 according to the present invention is employed with an internal combustion engine 11. Circuit 10 includes a stator assembly 12 mounted on the housing of engine 11 adjacent the periphery of a rotating element such as the engine flywheel 16. A north magnetic pole 18 and a south magnetic pole 20 are arranged on flywheel 16 for rotation therewith past stator 12 as indicated by the arrow 21. As flywheel 16 rotates past the stator 12, the magnetic flux existing between poles 18 and 20 passes through stator 12 to produce a time varying magnetic flux waveform in stator 12 in accordance with principles well known in the art. However, as will be seen in greater detail hereinafter, the particular way in which poles 18 and 20 are arranged and constructed relative to stator assembly 12 and the specific construction of the stator constitute inventive features of the present disclosure resulting in improved performance of a capacitor discharge ignition system.

Stator assembly 12 comprises a U-shaped core 22 having legs **22*a* and 22*b*. An ignition coil 24 comprising a primary winding 24*p* and a secondary winding 24*s* is wound on leg 22*a* while a charging and triggering coil 26 is wound on leg 22*b*. Winding 24*p* comprises terminals 24*p'* and 24*p''* and winding 24*s*, terminals 24*s'* and 24*s''*. Coil 26 comprises terminals 26' and 26''. Terminals 24*p''*, 24*s''* and 26'' are connected to ground G. A spark plug 28 is connected between ground and terminal 24*s'* and hence is across secondary winding 24*s*. (Although a single plug is illustrated, it will be appreciated that the invention may be practiced with multiple cylinder engines.) Preferably, coils 24 and 26 are wound on stator core 22 such that when a voltage is induced in coil 26 which makes terminal 26' positive, a voltage is induced in coil 24 which makes terminal 24*p'*** negative.

Circuit 10 further includes the following elements: an SCR 30, a capacitor 32, a resistor 34, a capacitor 36 and a capacitor 38. Capacitor 32 comprises a terminal **32*a* which is connected via a lead 40 to terminal 26' and a terminal 32*b* which is connected by a lead 42 to ground G. Hence capacitor 32 is connected directly across coil 26. SCR 30 comprises an anode terminal 30*a*, a gate terminal 30*g* and a cathode terminal 30*c*. Lead 40 connects terminal 30*a* with terminals 32*a* and 26'. In accordance with an important aspect of the present invention, the remaining circuit elements 34, 36 and 38 constitute a triggering circuit for triggering SCR 30 from coil 26. Resistor 34 and capacitor 36 are connected in parallel with each other. Terminal 34*a* of resistor 34 and terminal 36*a* of capacitor 36 are connected via lead 40 with terminals 30*a*, 32*a* and 26'. Terminal 34*b* of resistor 34 and terminal 36*a* of capacitor 36 are connected via a lead 44 with terminal 38*a* of capacitor 38 and gate terminal 30*g* of SCR 30. Terminal 30c of SCR 30 and terminal 38*b* of capacitor 38 are connected via a lead 46 to terminal 24***p*′.

Circuit 10 operates as follows. As flywheel 16 rotates, magnets 18 and 20 create a time varying magnetic flux in stator core 22. This time varying flux induces a voltage in coil 26 whose waveform includes positive polarity output which appear at terminal 26′. Thus with one magnetic pole pair on flywheel 16 (as illustrated in the drawing) one such positive pulse is generated for each revolution of the flywheel and in this way, the output waveform at terminal 26′ includes reptetitive pulses of positive polarity. Since capacitor 32 is coupled directly across coil 26, current flows from coil 26 in response to an initial portion of each positive pulse to charge capacitor 32. The aforementioned triggering circuit causes a triggering signal to be applied to gate terminal 30*g* in response to each positive pulse from coil 26. Capacitors 36 and 38 constitute a voltage dividing network for dividing the voltage output of coil 26 (i.e. the voltage across capacitor 32) and supplying a selected fraction of this voltage to the gate 30*g* of SCR 30. Capacitors 36 and 38 are selected such that when the desired voltage has been developed across capacitor 32, a sufficient voltage is applied by capacitor 38 across the gate-cathode of SCR 30 which causes the SCR to be triggered into conduction. Thus, capacitor 38 discharges across the gate-cathode junction of SCR 30 to trigger discharge of capacitor 32 into the ignition coil. Since the voltage applied to the gate of the SCR will be of similar waveform to the voltage waveform across capacitor 32, the requisite gate triggering voltage for turning on SCR 30 can be reached earlier in the waveform across capacitor 32 by increasing the capacitance of capacitor 36 relative to the capacitance of capacitor 38. Similarly, SCR 30 will be triggered later relative to the output waveform across capacitor 32 by increasing the capacitance of capacitor 38 relative to that of capacitor 36. In this way, the spark at plug 28 can be advanced or retarded relative to the operating position of the engine. The advantage of the capacitive voltage dividing network is that hard triggering of SCR 30 is afforded and response is improved over triggering circuits which have softer triggering characteristics. Although resistor 34 is preferred to lend a certain stability to the system, the basic triggering circuit is essentially determined by the characteristics of capacitors 36 and 38. It is contemplated, however, that slight modifications may be made such as adding additional resistance in the triggering circuit to tune the system in for optimum performance to match the characteristics of the specific charging and triggering coil of the ignition system.

When the triggering signal is applied to gate terminal 30*g* for rendering SCR 30 conductive, capacitor 32 and coil 26 are both immediately used to energize primary winding 24*p*. Thus, it is desirable for the gating signal for turning on SCR 30 to be generated while the voltage pulse at terminal 26′ still has an appreciable magnitude for supplying current from coil 26. With SCR 30 having been triggered into conduction, capacitor 32 discharges into primary winding 24 and current also flows from coil 26 into primary winding 24*p*. Also the voltage being presently induced in winding 24*p* by the changing magnetic flux in core 22 creates an additional component of current flow in primary winding 24*p*. Hence, it will be appreciated that a rapid change in magnetic flux in core 22 is created and this in turn generates a voltage in secondary winding 24*s* which causes spark plug 28 to fire.

The above enumerated advantages of the invention can now be fully understood. Since the same polarity pulse is used both to charge capacitor 21 and to trigger discharge of the capacitor by firing SCR through the triggering circuit, coil 26 can be wound on stator 22 as a single continuous winding, being wound in the same sense throughout its length and without the need of intermediate tapping. Moreover, circuit 10 requires a relatively small number of individual circuit components and this renders the invention suitable for compact packaging and economical manufacture. It will be noted in this regard also that the only solid state semiconductor which is required in the single SCr 30. It has also been found, contrary to expectations, that omssion of the usual charging diode provides improved circuit performance while at the same time reducing system cost. Heretofore, typical embodiments of capacitor discharge ignition systems had a charging diode interconnected between the charging coil and the capacitor. The charging diode prevented the accumulated charge on the capacitor from discharging back into the charging coil before the capacitor was discharged into the ignition coil. By omitting this diode, it has been found that a greater charge can be developed on the capacitor through what is believed to be a resonant effect. Although specific system construction will necessarily depend upon the particular system requirements, this resonant effect is developed primarily by the charging coil and capacitor constructions. Since specific construction values are difficult to mathematically derive in view of the harmonic content which typically characterizes the magneto output waveform, it is suggested that specific construction values for the charging coil and capacitor may be determining empirically. Desirably, the circuit is constructed so that the capacitor discharges into the ignition coil when the maximum charge is developed on the capacitor. A further benefit can be obtained by using a relatively high impedance primary winding 24*p* which tends to reduce the primary current. With the reduced primary current, a smaller, and hence less expensive, SCR can be used in the system. Moreover, the relatively high impedance of primary winding 24*p* benefits low speed operating performance by enhancing ringing in the circuit during firing of the plug.

In accordance with a modified form of the invention, it is possible to eliminate the triggering circuit for SCR 30 and to fire the SCR by means of breaking down the SCR with the potential applied to the anode terminal 30*a*. In this form, resistor 34, capacitor 36 and capacitor 38 are eliminated. Preferably, SCR 30 is selected to break down slightly before or at the maximum value of each positive output pulse from coil 26. With this type of firing for SCR 30, the circuit complexity is even further reduced and the circuit becomes even more economical. It has also been discovered that another type of breakdown device such as a spark gap will function satisfactorily, hence eliminating the need for any solid state device.

A further inventive feature of circuit 10 involves the way in which poles 18 and 20 are arranged and constructed relative to stator assembly 12. It will be observed in FIG. 1 that poles 18 and 20 are arranged and constructed in relation to stator 12 such that a first imaginary radial line circumferentially bisecting the radially outer face of pole 18 and a second imaginary radial line circumferentially bisecting the radially outer face of pole 20 have a smaller angular separation than do a third imaginary radial line circumferentially bisecting the radially inner face of leg 22*b* and a fourth imaginary radial line bisecting the radially inner face of leg 22*a*. In other words, the angular separation between the midpoints of legs 22*a* and 22*b* as measured circumferentially across the stator gap is greater than the angular separation between the midpoints of the two poles 18 and 20. It has been found that by increasing the circumferential separation of legs 22*a* and 22*b* relative to the circumferential separation of poles 18 and 20, as illustrated by way of example in FIG. 1, spark retard at higher engine rpms is avoided. Hence the particular construction of stator assembly 12 relative to poles 18 and 20 has the advantage of stabilizing to some extent the timing of the ignition spark.

A further benefit is attained by constructing the rotor magnet of a relatively high flux level magnetic material such as smarium cobalt. The use of a smarium cobalt magnet has been found to provide very desirable operating performance. It is preferable to provide a magnetic circuit with a minimum of stray flux paths when smarium cobalt is used for the magnetic material.

Figure 2:
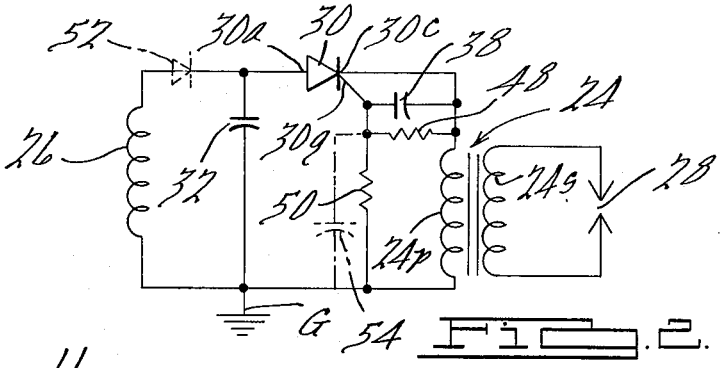
FIG. 2 is an electrical schematic diagram of a second embodiment of the invention.

FIG. 2 discloses another embodiment of the invention wherein like components from FIG. 1 are identified by like numerals. (Details of the structure of stator assembly 12 are not repeated in FIG. 2; hence coils 26 and 24 are only schematically illustrated.) In the circuit of FIG. 2, it will be observed that resistor 34 and capacitor 36 are omitted, and hence, that energy for triggering of SCR 30 is derived from primary winding 24*p*. In order to provide suitable triggering for SCR 30, a resistor 48 connects in parallel with capacitor 38, and a resistor 50 connects from gate 30*g* to ground G. Thus resistor 50, capacitor 38 and resistor 48 are across primary winding 24*p* and develop a suitable triggering signal for SCR 30 from the voltage induced in winding 24*p* by the revolving rotor. The effect of the various resistive and capacitive elements 38, 48 and 50 on the triggering of SCR 30 can best be summarized as follows. Assuming for the moment that capacitor 38, resistor 48 and resistor 50 are not electrically connected in circuit, SCR 30 will fire via a breakdown 350–for engine speeds as low as about 35014 400 rpm. When resistor 50 is added, SCR 30 can fire at engine speeds as low as about 100 rpm. By further adding capacitor 38, the lowest engine speed at which SCR 30 will fire is even further reduced to approximately 50 rpm. The provision of resistor 48 keeps the spark from retarding at very high engine rpm. Furthermore, it has been observed that the kilovolt output of spark plug 28 is substantially increased at these relatively low engine rpm, and it is believed that this may be due to a ringing effect provided by the capacitor. Thus it can be seen that with the appropriate selection of specific circuit component values, desired operational circuit performance for small gasoline engine ignition system applicable can be attained with a minimum of circuit complexity. As mentioned earlier, it is preferred to empirically determine specific component values for a given application.

In certain instances, it may be desirable to include a charging diode 52 and a capacitor 54 (shown in phantom in FIG. 2) either singly or in combination in the circuit. As illustrated in the drawing, charging diode 52 would be connected between charge coil 26 and capacitor 32, and capacitor 54 would be connected in shunt with resistor 50. While diode 52 would now necessarily prevent capacitor 32 from discharging back through charge coil 26 were SCR 30 not triggered in accordance with the resonant charging aspect of the invention described above, it is not the purpose of diode 52 to prevent such discharge. Rather, diode 52 is included to alleviate the effects of spikes which may occur in the output waveform developed across coil 26. The reason for including diode 52 is because with certain stator and rotor constructions, it has been observed that the output waveform of the charging coil can contain multiple spikes which may not be desirable. It has been found that the number of excess spikes (i.e., spikes in excess of one for single cylinder engines) can be minimized or eliminated by incorporating diode 52 and/or by changing the resistance of resistor 50. It has been found that increasing the resistance of resistor 50 helps to minimize the number of excess spikes. However, the resistance of resistor 50 necessary to provide proper operation of the circuit at high engine rpm was found to be too small to eliminate these spikes. By including capacitor 54, the number of extra spikes is minimized since the value of resistor 50 can now be increased to reduce the number of excess spikes while providing properly timed triggering action. At lower engine rpm, capacitor 54 provides enhanced voltage to the gate of SCR 30. Thus both diode 52 and capacitor 54 can improve performance in some instances.

Figure 3:
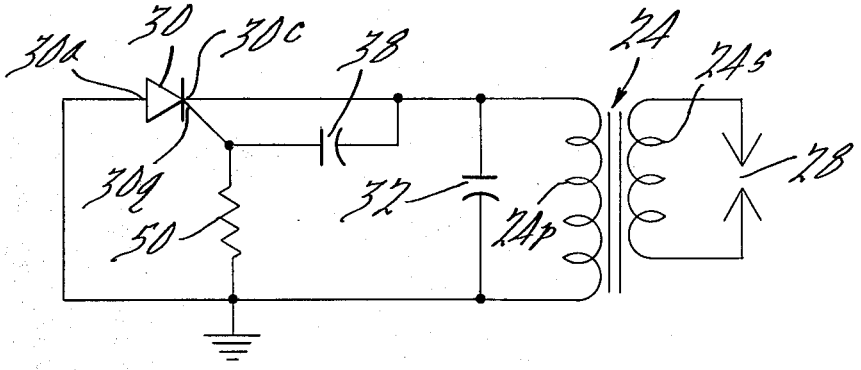
FIG. 3 is an electrical schematic diagram of a third embodiment of the invention.

In FIG. 3, a further embodiment of the invention is disclosed. In this embodiment charging coil 26 is omitted and primary winding 24*p* alone is used both for charging capacitor 32 and for triggering SCR 30. In this circuit, capacitor 32 connects directly across primary winding 24*p*, capacitor 38 connects as above between the gate-cathode of SCR 30 and resistor 50 connects from gate 30*g* to ground G. The anode of SCR 30 connects to ground. With this circuit, winding 24*p* energizes both capacitor 32 and capacitor 38. When capacitor 38 is sufficiently charged to trigger SCR 30, primary winding 24*p*, capacitor 32 and the series combination of resistor 50 and capacitor 38 are effectively short-circuited through the anode-cathode circuit of SCR 30. This creates a sudden large flux change in ignition coil 24 which fires spark plug 28. SCR 30 is turned off on the opposite polarity voltage of primary winding 24*p*. With this particular circuit construction the values of the various circuit elements are selectable to provide desired circuit operation for use with a small internal combustion engine. Alternatively the anode of SCR 30 could be connected to the ungrounded side of winding 24*p*, and the cathode of SCR 30 connected to the ground. In this instance the capacitor 38 will remain connected in the gate-cathode circuit of SCR 30 while resistor 50 would remain connected in the anode-gate circuit of SCR 30.

By way of example the following circuit values have been successfully employed in the circuit of FIGS. 2 and 3: capacitor 38, 0.05 microfarads; resistor 50, 15 kilohms when not using capacitor 54 and 22 kilohms when using capacitor 54; capacitor 32, 0.30 microfarads in FIG. 2 and 2.3 microfarads in FIG. 3; capacitor 54, 0.0002 microfarads.

It is to be understood that the foregoing description is that of preferred embodiments of the invention. Various changes and modifications may be made without departing from the spirit and scope of the invention as defined by the appended claims.

What is claimed is:

1. In a capacitor discharge ignition system the combination comprising a single charging and triggering coil, means for energizing said coil with a time-varying magnetic flux to thereby induce a time-varying voltage in said coil which voltage includes repetitive pulses of one polarity, an ignition coil comprising a primary winding and a secondary winding, a spark plug connected across said secondary winding, a capacitor, charging circuit means coupling said capacitor with said charging and triggering coil for causing said capacitor to be charged by said coil in response to an initial portion of each of said pulses, discharge circuit means operatively coupling said capacitor with said primary winding so that said capacitor can discharge into said primary winding to cause said spark plug to fire, said discharge circuit means including a solid state switch having first and second terminals via which terminals said capacitor discharges into said primary winding when said switch is actuated and a third terminal constituting a triggering terminal via which said switch is actuated in response to a triggering signal applied thereto, and triggering circuit means operatively coupled with said discharge means and with said single charging and triggering coil for causing said capacitor to discharge into said primary winding in response to a portion of each of said pulses occurring after said initial portion thereof, said triggering circuit means including a capacitor voltage dividing network connected to said coil with said third terminal connected to an intermediate point thereof, and a resistor connected in parallel with a portion of said capacitor voltage dividing network.

2. The combination of claim 1 wherein said capacitor is electrically connected across said charging and triggering coil.

3. The combination of claim 1 wherein said solid state switch comprises an SCR.

4. The combination of claim 1 wherein said capacitive voltage dividing network comprises a pair of additional capacitors connected in series with each other and across said charging and triggering coil.

5. The combination of claim 1 wherein said charging and triggering coil and said ignition coil are magnetically coupled and arranged such that the voltage induced in said primary coil tends to aid the voltage induced in said charging and triggering coil.

6. The combination of claim 1 wherein said solid state switch comprises an SCR and said triggering terminal is the gate terminal of said SCR and said capacitor network comprises the series combination of two capacitors connected across said first-mentioned capacitor.

7. The combination of claim 6 wherein said resistor is connected in shunt with one of said two capacitors.

8. The combination of claim 7 wherein the anode terminal of the SCR is connected to the output of said charging and triggering coil.

9. The combination of claim 1 wherein said triggering circuit means is arranged to initiate discharge of said capacitor before the magnitude of the output pulse begins to decline from its maximum value.

10. A capacitor discharge ignition circuit comprising a stator coil, means for energizing said coil with varying magnetic flux to thereby induce a time-varying voltage in said coil which voltage includes repetitive pulses of one polarity, an ignition coil comprising a primary winding and a secondary winding, single magnetic core means magnetically coupling said primary winding and said stator coil, a spark plug connected across said secondary winding, a capacitor, means for charging said capacitor from said stator coil for an initial portion of each of said pulses, and means for cooperatively energizing said primary winding from both said capacitor and said stator coil for a subsequent portion of each pulse to energize said secondary winding thereby energizing said spark plug, said single magnetic core means and said energizing means being adapted to further energize said primary winding in cooperation with the energization of said primary winding by said capacitor and said stator coil to enhance the energization of said secondary winding and said spark plug.

11. The circuit of claim 10 wherein said magnetic coupling of said primary winding with said stator coil induces a voltage in said primary winding which aids said voltage pulses of said stator coil.

12. The combination of claim 10 wherein the initial portion of each pulse occurs before the peak amplitude of the pulse.

13. In a capacitor discharge ignition circuit the combination comprising an ignition coil having a primary and a secondary winding coil, a stator core on which said primary and secondary windings are disposed, a magnetic structure including a north magnetic pole and a south magnetic pole for energizing said primary winding through said stator core with a time-varying magnetic flux such that said primary winding generates an output waveform which includes repetitive pulses of one polarity, a spark plug, a main capacitor, a charge coil also disposed on said stator core being energized by said time-varying magnetic flux provided by said north and south magnetic poles for energizing said main capacitor, a solid state switch means connecting said capacitor to said primary winding, said solid state switch means being arranged to conduct current from said capacitor to said primary winding in response to a trigger signal and triggering circuit means coupling said primary coil and said solid state switch means such that said solid state switch means is rendered conductive in response to a trigger signal derived from said pulses generated by said primary winding upon energization thereof by said time-varying magnetic flux provided by said north and south magnetic poles, which trigger signal occurs after said capacitor has been energized.

14. The combination of claim 13 wherein said solid state switch means is an SCR having a gate and said trigger circuit means comprises a circuit connecting said primary winding to the gate of said SCR.

15. The combination of claim 14 wherein said SCR is rendered conductive prior to the latter half of each pulse.

16. In a capacitor discharge ignition circuit the combination comprising a stator coil, means for energizing said coil with a time-varying magnetic flux such that said coil generates an output waveform which includes repetitive pulses of one polarity, an ignition coil comprising a primary winding and a secondary winding, a spark plug connected across said secondary winding, a capacitor connected across said stator coil, breakdown means without a trigger connection for breakdown thereof connecting a junction of said capacitor and said stator coil to said primary winding, said breakdown means being arranged to conduct current from said capacitor and said stator coil to said primary winding, said breakdown means conducting by breakdown thereof, said breakdown being caused by the output pulse from said stator coil reaching a selected magnitude sufficient to break down said breakdown means, said capacitor discharging into said primary winding in response to breakdown of said breakdown means to cause said spark plug to fire.

17. In a capacitor discharge ignition system the combination comprising: a secondary winding means and a spark plug means connected thereacross, a coil means; means for energizing said coil means with a time-varying magnetic flux to thereby develop a time-varying electrical output waveform across said coil means which waveform includes repetitive pulses of similar polarity; a capacitor means; a bi-directional current path means coupling said capacitor means with said coil means such that said capacitor is charged by said coil means with the voltage across said capacitor means tending to follow the output waveform developed across said coil means by said time-varying magnetic flux; discharge circuit means adapted to be triggered by said pulses from said coil means so as to cause discharge of said capacitor means; said coil means, said capacitor means and said discharge circuit means being arranged such that said capacitor means charges in response to an initial portion of each of said pulses, said discharge circuit means is triggered by said pulses from said coil means at the end of each of said initial portions of each pulse, said secondary winding means being energized in response to discharge of said capacitor means to cause said spark plug means to fire.

18. The combination of claim 12 wherein said capacitor means is coupled directly across said coil means by said bi-directional current path means.

19. The combination of claim 18 wherein said discharge circuit means includes an SCR.

20. The combination of claim 19 wherein the anode-cathode circuit of said SCR is coupled in parallel with said capacitor means and with said coil means.

21. The combination of claim 20 including triggering circuit means for triggering said discharge circuit means such that said capacitor means is discharged at the end of each initial portion of each pulse.

22. The combination of claim 21 wherein said triggering circuit means comprises a resistor-capacitor network.

23. The combination of claim 22 wherein said resistor-capacitor network comprises a resistor element and a capacitor element connected in series with each other and across said coil means, and the junction of said resistor element and said capacitor element being connected to the gate of said SCR.

24. The combination of claim 23 including an additional capacitor element connected in shunt with said resistor element.

25. The combination of claim 24 including an additional resistor element connected in shunt with said first-mentioned capacitor element.

26. The combination of claim 25 including a charging diode connected between said coil means and said capacitor means adapted to suppress the effect on said system of spikes in the output waveform of said first coil element.

27. The combination of claim 22 wherein said resistor-capacitor netowork comprises at least one circuit element connected between the gate and anode of said SCR and at least one second circuit element connected between the gate and cathode of said SCR.

28. The combination of claim 27 wherein said at least one second circuit element comprises a capacitor element.

29. The combination of claim 28 further including a resistor element connected in parallel with said capacitor element.

30. The combination of claim 17 wherein said means for energizing said coil means comprises a smarium cobalt magnet.

31. The combination of claim 17 wherein said means for energizing said coil means comprises a north magnetic pole and a south magnetic pole arranged to sweep past said coil means, said coil means being mounted on a stator core comprising a pair of circumferentially spaced legs and wherein the circumferential spacing between the midpoints of said north and south poles is less than the circumferential spacing between the midpoints of said stator core legs.

32. In a capacitor discharge ignition system wherein the system operates to perform a first function of charging a capacitor; a second function of triggering discharge of the charged capacitor; and a third function of firing a spark plug in response to discharge of the capacitor; the combination with said capacitor of: a coil from which energy is derived to perform at least two of said three functions; means for energizing said coil with a time-varying magnetic flux to thereby develop a time-varying electrical output waveform across said coil which waveform includes repetitive pulses of similar polarity; discharge means adapted to be triggered in timed relation to each of said pulses for triggering discharge of said capacitor; a secondary winding across which the spark plug is connected; a bi-directional current path connecting said coil to said capacitor for charging said capacitor in response to an initial portion of each pulse, said discharge means being triggered at the termination of each initial portion of each pulse such that the capacitor suddenly discharges, discharge of said capacitor causing a sudden change in magnetic flux in said secondary winding to thereby fire the spark plug.

33. The combination of claim 32 wherein said capacitor is connected directly across said coil.

34. The combination of claim 33 wherein said discharge means comprises an SCR and including triggering circuit means connected between said coil and the gate of said SCR for triggering said SCR into conduction in timed relation to each of said pulses to thereby effect discharge of said capacitor.

35. The combination of claim 34 wherein SCR is connected directly across said capacitor and said coil.

36. The combination of claim 35 wherein said trigger circuit means comprises the combination of a resistor element and capacitor element in series with each other across said coil and the junction of said resistor and capacitor is connected to the gate of said SCR.

37. The combination of claim 36 wherein said capacitor element is connected between the gate-cathode of said SCR and said resistor is connected between the anode-gate of said SCR.

38. The combination of claim 37 including an additional capacitor element connected in shunt with said resistor element.

39. The combination of claim 30 wherein said discharge means includes an SCR and including triggering circuit means coupling said coil to the gate of said SCR for triggering said SCR into conduction in timed relation to each of said pulses to thereby effect discharge of said capacitor.

40. The combination of claim 37 wherein said triggering circuit means comprises a first resistor connected in series with the parallel combination of a second resistor and a capacitor element, said series combination being connected across said coil and the junction of said two resistors and said capacitor element being connected to the gate of said SCR.

41. The combination of claim 39 wherein said triggering circuit means comprises a resistor element and a capacitor element connected in series across said coil and the junction of said resistor element and said capacitor element or is connected to the gate of said SCR.

42. The combination of claim 41 wherein said capacitor element is connected between the gate-cathode of said SCR and said resistor element is connected between the anode-gate of said SCR.

* * * * *

UNITED STATES PATENT AND TRADEMARK OFFICE

CERTIFICATE OF CORRECTION

PATENT NO. : 3,941,111

DATED : March 2, 1976

INVENTOR(S) : THOMAS F. CARMICHAEL & RICHARD J. MAIER

It is certified that error appears in the above-identified patent and that said Letters Patent are hereby corrected as shown below:

Column 2, line 64, "36a" should be --36b--.
Column 4, line 3, "21" should be --32--.
Column 4, line 13, "SCr" should be --SCR--.
Column 4, line 13, after "required", "in" should be --is--.
Column 5, line 42, delete "350-" and insert --effect--.
Column 5, line 43, "35014 400" should be --350-400--.
Column 5, line 56, "applicable" should be --application--.
Column 9, line 26, Claim 18, line 1, "12" should be --17--.
Column 10, line 44, Claim 35, line 1, after "wherein" insert --said--.
Column 10, line 58, Claim 39, line 1, "30" should be --32--.
Column 10, line 64, Claim 40, line 1, "37" should be --39--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*